US006362158B1

(12) United States Patent
Grandmaire et al.

(10) Patent No.: US 6,362,158 B1
(45) Date of Patent: Mar. 26, 2002

(54) MULTI-PHASE CLEAR FABRIC SOFTENING COMPOSITION

(75) Inventors: Jean-Paul Grandmaire, Andrimont; Anita Hermosilla, Othee, both of (BE)

(73) Assignee: Colgate-Palmolive Co., New York, NY (US)

( * ) Notice: Subject to any disclaimer, the term of this patent is extended or adjusted under 35 U.S.C. 154(b) by 0 days.

(21) Appl. No.: 09/607,033

(22) Filed: Jun. 29, 2000

(51) Int. Cl.[7] ..... C11D 3/44; C11D 1/38
(52) U.S. Cl. ..... 510/522; 510/525; 510/527
(58) Field of Search ..... 510/522, 525, 510/527

(56) References Cited

U.S. PATENT DOCUMENTS

| | | | | |
|---|---|---|---|---|
| 5,525,245 A | | 6/1996 | Grandmaire et al. | 252/8.8 |
| 5,656,585 A | | 8/1997 | Grandmaire et al. | 510/524 |
| 5,747,443 A | * | 5/1998 | Wahl et al. | 510/515 |
| 5,759,990 A | | 6/1998 | Wahl et al. | 510/515 |
| 6,235,914 B1 | * | 5/2001 | Steiger et al. | 554/114 |

FOREIGN PATENT DOCUMENTS

| | | |
|---|---|---|
| WO | WO 98/47991 | * 10/1998 |

* cited by examiner

*Primary Examiner*—John Hardee
(74) *Attorney, Agent, or Firm*—Bernard Lieberman

(57) ABSTRACT

An aqueous multi-phase liquid fabric softener composition comprised of at least two phases, all of said phases being transparent or translucent, said fabric softener composition comprising:

(a) from about 5% to about 45%, by weight, of a cationic softening material;

(b) from about 5% to about 15%, by weight, of a solvent having a partition coefficient of log P of from about 0.70 to about 2.0;

(c) from about 0.2% to about 1.5%, by weight, of a mineral electrolyte;

(d) a water-immiscible oil-based perfume in an amount sufficient to provide the desired degree of fragrance; and (d) balance water whereby said multi-phase softener composition is capable of being converted to a milky macroemulsion upon dilution with water.

9 Claims, No Drawings

MULTI-PHASE CLEAR FABRIC SOFTENING COMPOSITION

This invention relates to rinse cycle fabric softener compositions. More particularly, it relates to an aqueous multi-phase liquid fabric softener composition comprising at least two transparent or translucent phases.

Multi-phase compositions which are transparent or clear are well-known in products intended for personal care such as bath oils and shower products, but not in fabric softening compositions. The various technologies which are used to obtain a clear multi-phase aesthetic effect generally rely on compositions containing oil and/or anionic surfactants that are generally incompatible with cationic surfactants and, particularly with the type of cationic surfactant required to provide a fabric softening composition which is both efficacious and transparent or clear.

Clear single phase fabric softening compositions are described in the patent literature. U.S. Pat. Nos. 5,525,245 and 5,656,585 assigned to Colgate-Palmolive, and U.S. Pat. No. 5,427,697 to Procter & Gamble describe single phase solutions or microemulsions which contain fabric softening ingredients. The microemulsions of the aforementioned '245 and '585 patents are said to be converted to macroemulsions having a turbid or milky appearance upon dilution with water in the rinse cycle thereby enabling fabric softening to occur.

While consumer preference often favors the aesthetic of clarity in fabric softener compositions, there remains as an object of the prior art the ability to provide a multi-phase fabric softener composition in which all phases are either clear or transparent or translucent, notwithstanding that such composition contains one or more cationic softening ingredients. In addition to the enhanced aesthetic properties, the resulting composition must also provide efficacious fabric softening when used as a rinse cycle softening composition.

SUMMARY OF THE INVENTION

The objects cited above are satisfied by an aqueous multi-phase liquid fabric softener composition comprised of at least two phases, all of said phases being transparent or translucent, said fabric softener composition comprising:

(a) from about 5% to about 45%, by weight, of a cationic softening material;

(b) from about 5% to about 15%, by weight, of a solvent having a partition coefficient of log P of from about 0.70 to about 2.0;

(c) from about 0.2% to about 1.5%, by weight, of a mineral electrolyte;

(d) a water-immiscible oil-based perfume in a sufficient amount to provide the desired degree of fragrance; and (e) balance water whereby said multi-phase softener composition is capable of being converted to a milky macroemulsion upon dilution with water.

The present invention is predicated upon the discovery that the selection of a solvent and a mineral electrolyte in accordance with the invention when combined with a diester quaternary ammonium fabric softener as herein described provide an efficacious liquid fabric softener having at least two phases and wherein each phase manifests the desired aesthetic property of being transparent or translucent.

All of the ingredients of the softening composition must be normally liquid, namely, liquid at ambient room-temperature.

DETAILED DESCRIPTION OF THE INVENTION

The cationic softening material for purposes of the invention is preferably a diester quaternary ammonium surfactant fabric softener selected from the group having the structural formulae as follows:

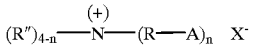

(I)

wherein each

A is independently C(O)O—R' or —(O(O)—C—R';

R is a lower group having 1 to about 4 carbon atoms;

R' is an alkyl or alkenyl group having 8 to about 22 carbon atoms;

R" is independently a lower alkyl radical having 1 to about 6 carbon atoms or hydroxyl alkyl group;

n is an integer having a value of 1 to about 3;

X is a softener compatible anion, preferably selected from the group consisting of a halide ion and methyl or ethyl sulfate; and

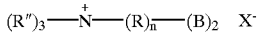

(II)

wherein B independently is A or $(R)_n$—A; and A, R, R" and n are as defined above; and

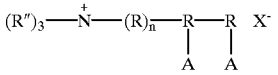

(III)

wherein A, R, R" and n are as defined above.

The preferred diester quaternary ammonium surfactant fabric softeners are represented by equation (I) above and are commercially available from Stepan Co. as Stepantex and from Kao Corp. as Tetranyl but can also be synthesized by the reaction of two moles of a fatty acid with a trialkanolamine optionally followed by alkoxylation and methylation with dimethyl sulfate or an alkyl halide such as, methyl iodide. In a preferred mode the fatty acid is oleic acid and ethylene oxide is used as the alkoxylation agent. For economical reasons it has been found that Soya fatty acids are a practical source for this purpose consisting of about 3% myristic acid, about 5% palmitic acid, about 5% palmitoleic acid, 1.5% stearic acid, 72.5% oleic acid and about 13% linoleic acid. Other sources of useful fatty acids are those obtained from the saponification of beef tallow, butter, corn oil, cottonseed oil, lard, olive oil, palm oil, peanut oil, cod liver oil, coconut oil and the like.

A preferred diester quaternary ammonium surfactant fabric softener is methyl bis[ethyl(oleyl)]-2-hydroxyethyl ammonium methyl sulfate. This quaternary ammonium compound is often referred to herein as dioleyl diesterquat (or "DODEQ").

Other diesters useful in the practice of this invention include:

methyl bis-[ethyl(coconut)]-2-hydroxyethyl ammonium methyl sulfate methyl bis-[ethyl(decyl)]-2-hydroxyethyl ammonium methyl sulfate methyl bis-[ethyl(dodecyl)]-2-hydroxyethyl ammonium methyl sulfate methyl bis-[ethyl(lauryl)]-2-hydroxyethyl ammonium methyl sulfate methyl bis-[ethyl(palmityl)]-2-hydroxyethyl ammonium methyl sulfate methyl bis-[ethyl(soft-tallow)]-2-hydroxyethyl ammonium methyl sulfate, and the like.

The designation of the terms coconut and beef tallow indicate mixtures of esters corresponding to the fatty acid source.

In the preparation of the diester quaternary ammonium surfactants, a certain amount of the triester homolog may be produced as an impurity. Unlike the diester, it is not soluble in water and has to be considered as an oil to be emulsified.

The term "oil-based perfume" is used herein in its ordinary sense to refer to and include any non water-soluble fragrant substance or mixture of substances including natural (i.e., obtained by extraction of flower, herb, blossom or plant), artificial (i.e., a mixture of natural oils or oil constituents) and synthetic (i.e., a single or mixture of synthetically produced substance) odoriferous substances. Typically perfumes are complex mixtures of blends of various organic compounds, such as, esters, ketones, hydrocarbons, lactones, alcohols, aldehydes, ethers, aromatic compounds and varying amounts of essential oils (e.g., terpenes) such as from about 0% to about 80%, usually from about 10% to 70% by weight, the essential oils themselves being volatile odoriferous compounds and also serving to dissolve the other components of the perfume. The precise composition of the perfume has no particular effect on fabric softening so long as it meets the criteria of water immiscibility and pleasant odor. The level of perfume in the present softener compositions will generally vary from about 0.1% to about 2.5%, by weight.

The solvents useful for the present invention are selected based on their octanol/water partition coefficient (P). This coefficient is the ratio between the equilibrium concentration of the particular solvent in octanol and in water. The coefficient is commonly provided in the technical literature as the logarithm (to the base 10) of P, namely, log P.

The value of log P of many solvents is often available from the solvent supplier or may be calculated, the "calculated log P" being referred to as C log P. For many solvents, the value of log P is reported and available from Daylight Chemical Information Systems Inc. (Daylight CIS), Irvine, Calif. on the Pomona 92 database. Log P values are also conveniently calculated by the "C log P" program, also available from Daylight CIS. The C log P values are determined based on the fragment approach of Hansch and Leo (cf., A. Leo, in Comprehensive Medicinal Chemistry, Vol. 4, C. Hansch, P. G. Sammens, J. B. Taylor and C. A. Ramsden Eds., p. 295, Pergamon Press, 1990, incorporated herein by reference).

Solvents generally useful for the present invention are those having a partition coefficient of log P of from about 0.70 to about 2.0. The particularly preferred range of log P is from about 1.5 to about 2.0.

Preferred solvents for use in the present invention are the following, the value of log P being indicated alongside in parentheses: dipropylene glycol n-propyl ether (0.994); tripropylene glycol n-butyl ether (1.896); dipropylene glycol n-butyl ether (1.523); tripropylene glycol n-butyl ether (1.9); and propylene glycol n-butyl (1.15). Other useful solvents are diols and alcohols, such as, trimethyl pentane diol (1.24); pentanol (1.3); and hexanol (2.0).

Preferred mineral electrolytes suitable for use in this invention include: sodium sulfate; sodium nitrate; calcium chloride; ammonium sulfate; potassium chloride; potassium nitrate; calcium nitrate; magnesium nitrate; and magnesium sulfate.

An important aesthetic property of the present liquid fabric softening compositions is that following vigorous agitation of the composition, such as by hand shaking, the multi-phase product is temporarily converted to a milky macroemulsion. However, after a period of time ranging from about 5 minutes to about 12 hours, phase separation occurs although not as clear or transparent phases. After a period of about 5 hours to 72 hours, the original clear multiple phases reappear to restore the original aesthetic property of the composition. Also, when diluted in the rinse water, the multi-phase composition forms a macroemulsion thereby enabling the softening ingredients which are no longer solubilized in solution or microemulsion form to contact the fabrics in the rinse bath and provide the desired softening effect.

EXAMPLE 1

A typical composition in accordance with the invention is comprised as follows:

| Component | Wt. Percent |
|---|---|
| DODEQ[(1)] | 21.8 |
| $Na_2SO_4$ | 0.5 |
| Perfume | 1.2 |
| Pentanol | 5.0 |
| Water | 71.4 |

[(1)]DODEQ refers to 90% Dioleyl Diesterquat plus 10% ethanol.

The above-described composition is characterized by two clear or transparent phases. Upon agitation the composition becomes turbid or milky. Following such agitation, phase separation occurs within about 3 minutes and the composition returns to its clear condition within about 5 hours.

EXAMPLE 2

Compositions A–E were prepared as shown in Table 1 to compare the aesthetic appearance of compositions in accordance with the invention (B and C) with compositions outside the invention (A, D and E) all of the compositions being identical except for the selection of solvent. The value of log P for each solvent is indicated in parentheses.

TABLE 1

| Component | Composition A | Composition B | Composition C | Composition D | Composition E |
|---|---|---|---|---|---|
| Water | 71.4 wt % | 71.4 wt % | 71.4 wt % | 7.14 wt % | 71.4 wt % |
| DODEQ | 21.8 | 21.8 | 21.8 | 21.8 | 21.8 |
| Perfume | 1.2 | 1.2 | 1.2 | 1.2 | 1.2 |
| $Na_2SO_4$ | 0.25 | 0.25 | 0.25 | 0.25 | 0.25 |
| Propanol (log P = 0.3) | 5 | — | — | — | — |
| Pentanol (log P = 1.3) | — | 5 | — | — | — |
| Hexanol (log P = 2.0) | — | — | 5 | — | — |
| Octanol (log P = 3.15) | — | — | — | 5 | — |
| Decanol (log P = 3.32) | — | — | — | — | 5 |
| Appearance | Turbid | 3 Clear Phases | 3 Clear Phases | Turbid Gel | White Gel |

As noted in Table 1, compositions B and C containing solvents having partition coefficients in accordance with the invention provided the desired aesthetic appearance of a clear multi-phase composition. In contrast thereto, compositions A, D and E containing solvents having values of log P outside the invention resulted in an undesired aesthetic appearance of turbidity associated with the formation of a macro-emulsion.

EXAMPLE 3

Compositions F–H were prepared as shown in Table 2 to demonstrate the difference in aesthetic appearance provided by a composition in accordance with the invention (H) relative to compositions outside the invention (F and G) wherein the compositions differ only with respect to the selection of solvent.

TABLE 2

| | Weight % of Components | | |
|---|---|---|---|
| Component | Composition F | Composition G | Composition H |
| Water | 71.4 | 71.4 | 71.4 |
| DODEQ | 21.8 | 21.8 | 21.8 |
| Perfume | 1.2 | 1.2 | 1.2 |
| $Na_2SO_4$ | 0.5 | 0.5 | 0.5 |
| Propylene Glycol (log P = −1.4) | 5 | — | — |
| 1-4 Butanediol (log P = −1.3) | — | 5 | — |
| Trimethyl Pentanediol (log P = 1.24) | — | — | 5 |
| Appearance | Turbid Gel | Turbid Gel | 2 Clear Phases |

As noted in Table 2, Composition H in accordance with the invention provided the desired aesthetic appearance in contrast to compositions F and G containing solvents not in accordance with the invention which were turbid or milky in appearance.

EXAMPLE 4

Compositions I–M were prepared as shown in Table 3 using various propylene glycol ether solvents. The aesthetic appearance was noted for compositions in accordance with the invention (J, K, L and M) versus a composition outside the invention (I).

TABLE 3

| | Composition I | Composition J | Composition K | Composition L | Composition M |
|---|---|---|---|---|---|
| Water | 71.4 wt % | 71.4 wt % | 71.4 wt % | 7.14 wt % | 71.4 wt % |
| DODEQ | 21.8 | 21.8 | 21.8 | 21.8 | 21.8 |
| Perfume | 1.2 | 1.2 | 1.2 | 1.2 | 1.2 |
| $Na_2SO_4$ | 0.5 | 0.5 | 0.5 | 0.5 | 0.5 |
| PnP (log P = 0.62)[1] | 7.5 | — | — | — | — |
| DPnP (log P = 0.99)[2] | — | 7.5 | — | — | — |
| DPnB (log P = 1.52)[3] | — | — | 7.5 | — | — |
| TPnB (log P = 1.9)[4] | — | — | — | 7.5 | — |
| PnB (log P = 1.15)[5] | — | — | — | — | 7.5 |

TABLE 3-continued

| | Composition I | Composition J | Composition K | Composition L | Composition M |
|---|---|---|---|---|---|
| Appearance | Turbid | 2 Clear Phases | 2 Clear Phases | 2 Clear Phases | 2 Clear Phases |

[1]PnP refers to a Dowanol solvent which is propylene glycol n-propyl ether
[2]DPnP refers to a Dowanol solvent which is dipropylene glycol n-propyl ether
[3]DPnB refers to a Dowanol solvent which is dipropylene glycol n-butyl ether
[4]TPnB refers to tripropylene glycol n-butyl ether
[5]PnB refers to propylene glycol n-butyl ether As noted in Table 3, Composition I which is characterized by a solvent having a value of log P outside of the invention did not provide the desired aesthetic appearance of clarity and multiple phases. Compositions J, K, L and M manifested 2 clear phases.

EXAMPLE 5

This Example compares the effect of using various electrolytes in two prototype compositions, I and II shown below:

| Component | Composition I | Composition II |
|---|---|---|
| Water | 71.4 wt % | 71.4 wt % |
| DODEQ | 16.67 | 16.67 |
| Perfume | 1.2 | 1.2 |
| Electrolyte | 0.5 | 0.9 |
| TPnB | 5 | 5 |

Mineral electrolytes (in accordance with the invention) and organic electrolytes (outside the invention) were used in prototype compositions I and II with the resulting aesthetic appearance being indicated as shown in Table 4 below:

TABLE 4

Appearance of Compositions I and II with Various Electrolytes

| | Electrolyte | Composition I Examples 1–12 | | Composition II Examples 13–24 | |
|---|---|---|---|---|---|
| Mineral Electrolytes | $Na_2SO_4$ | Ex. 1 | 2 Clear Phases | Ex. 13 | 2 Clear Phases |
| | NaCl | 2 | 2 Clear Phases | 14 | 2 Clear Phases |
| | $NaNO_3$ | 3 | 2 Clear Phases | 15 | 2 Clear Phases |
| | $CaCl_2$ | 4 | 2 Clear Phases | 16 | 2 Clear Phases |
| | $MgCl_2$ | 5 | 2 Clear Phases | 17 | 2 Clear Phases |
| | $NH_4$ Sulfate | 6 | 2 Clear Phases | 18 | 2 Clear Phases |
| Organic Electrolytes | Quaternized TEA | 7 | Turbid | 19 | 2 Clear Phases |
| | Na Benzoate | 8 | Turbid | 20 | 2 Clear Phases |
| | Na Gluconate | 9 | Turbid | 21 | Turbid |
| | Na Citrate | 10 | Turbid | 22 | 3 Clear Phases |
| | Na Tartrate | 11 | Turbid | 23 | Turbid |
| | Ca Formiate | 12 | Turbid | 24 | Turbid |

As noted in Table 4, clear or transparent dual phase compositions were obtained with all of the mineral electrolytes tested in compositions I and II, all of which are compositions in accordance with the invention. The use of organic electrolytes (outside of the invention) resulted primarily in turbid or milky compositions, although in a few examples at the higher concentration level of electrolyte (Examples 19, 20 and 22), clear multiphase products were obtained.

EXAMPLE 6

The softening performance of a composition in accordance with the invention was compared to that of a commercial rinse cycle softening composition. Specifically, composition L described in Example 4, Table 3 (containing 21.8% DODEQ, 90% of which is active softener ingredient) was evaluated for softening performance versus a commercial concentrated fabric softening composition containing a comparable amount of softener ingredients (reference composition). The dosage for both compositions in the rinse cycle was 28 ml.

Test fabrics to be evaluated were first desized to remove the finish. The test fabrics were introduced into a standard fabric load and treated in a European washing machine under European detergent and water hardness conditions.

The washed fabrics were line dried and the test fabrics were then evaluated through pair testing using a panel of judges.

The resulting softness delivered by the composition of the invention (composition L) was judged to be essentially equivalent to the softness delivered by the reference composition.

What is claimed is:

1. An aqueous multi-phase liquid fabric softener composition comprising three transparent phases, said fabric softener composition comprising:

(a) from about 5% to about 45%, by weight, of a cationic softening material;

(b) from about 5% to about 15%, by weight, of a solvent having a partition coefficient of log P of from about 0.70 to about 2.0;

(c) from about 0.2% to about 1.5%, by weight, of a mineral electrolyte;

(d) a water-immiscible oil-based perfume in an amount sufficient to provide the desired degree of fragrance; and (d) balance water whereby said multi-phase softener composition is capable of being converted to a milky macroemulsion upon dilution with water.

2. An aqueous fabric softener composition in accordance with claim 1 wherein said solvent is an alcohol or a diol.

3. An aqueous fabric softener composition in accordance with claim 1 wherein said solvent is dipropylene glycol n-propyl ether.

4. An aqueous fabric softener composition in accordance with claim 1 wherein said solvent is dipropylene glycol n-butyl ether.

5. An aqueous fabric softener composition in accordance with claim 1 wherein said solvent is tripropylene glycol n-butyl ether.

6. An aqueous fabric softener composition in accordance with claim 1 wherein said solvent is a propylene glycol ether.

7. An aqueous fabric softener composition in accordance with claim 1 wherein the cationic softening material is a diester quaternary ammonium surfactant.

8. An aqueous fabric softener composition as in claim 7 wherein the diester is methyl bis[ethyl(oleyl)]-2-hydroxyethyl ammonium methyl sulfate.

9. A method of softening fabrics comprising the step of contacting said fabrics in a rinse bath with an effective amount of the fabric softener composition of claim 1.

* * * * *